US005143151A

United States Patent [19]

Pain

[11] Patent Number: 5,143,151

[45] Date of Patent: Sep. 1, 1992

[54] END MANIFOLD FOR A HEAT EXCHANGER

[75] Inventor: Ronald A. Pain, Eltham, Australia

[73] Assignee: Heat Transfer Pty. Ltd., Victoria, Australia

[21] Appl. No.: 671,875

[22] PCT Filed: Oct. 12, 1989

[86] PCT No.: PCT/AU89/00447

§ 371 Date: Apr. 12, 1991

§ 102(e) Date: Apr. 12, 1991

[87] PCT Pub. No.: WO90/04147

PCT Pub. Date: Apr. 19, 1990

[30] Foreign Application Priority Data

Oct. 12, 1988 [AU] Australia ..... PJ0938/88

[51] Int. Cl.[5] ..... F28D 7/10

[52] U.S. Cl. ..... 165/154; 165/141; 165/155

[58] Field of Search ..... 165/141, 154, 155

[56] References Cited

U.S. PATENT DOCUMENTS

| | | | |
|---|---|---|---|
| 3,209,819 | 10/1965 | LeClercq | 165/155 |
| 3,561,417 | 2/1971 | Downey | 123/196 |
| 4,146,088 | 3/1979 | Pain | 165/141 |
| 4,448,243 | 5/1984 | Pain | 165/134.1 |

FOREIGN PATENT DOCUMENTS

| | | | |
|---|---|---|---|
| 4832 | of 1903 | United Kingdom | 165/155 |
| 278000 | 5/1928 | United Kingdom | 165/155 |

*Primary Examiner*—Allen J. Flanigan

*Attorney, Agent, or Firm*—Blakely Sokoloff Taylor & Zafman

[57] ABSTRACT

An end manifold (2) for a concentric tube heat exchanger, the end manifold being especially suitable for treatment of viscous fluids. The end manifold has an obliquely oriented shoulder (38) which serves to direct the viscous fluid into an outlet port (30) so as to avoid stagnant regions of the viscous fluid which would be otherwise subjected to overheating. The same manifold can be used at the inlet end as well as for cooling purposes and allows for more effective cleaning when a cleaning fluid is circulated therethrough.

13 Claims, 7 Drawing Sheets

END MANIFOLD FOR A HEAT EXCHANGER

This invention relates to an end manifold for a heat exchanger.

More particularly, the invention relates to an end manifold for a heat exchanger having coaxially arranged tubes of the type generally shown in Australian Patent No. 510518.

When the heat exchangers of the type noted above are used to heat or cool liquids, particularly viscous liquids, there is a tendency for regions of zero flow to develop. Typically, the viscous material tends to accumulate at points which are diametrically opposite to the port through which the viscous material leaves the end manifold. When the viscous material is being heated, the stagnated viscous material can be overheated and burnt. This can cause contamination of other viscous material flowing through the heat exchanger. The burnt material is also difficult to clean. When the heat exchanger is being used to cool liquids, there is a tendency for the stagnant material to over-cool or freeze which is also undesirable. Further, regions of zero flow are very undesirable during cleaning operations when a cleaning fluid is circulated through the heat exchanger because effective cleaning cannot take place in those regions.

An object of the present invention is to provide a new form of end manifold which substantially avoids regions of zero flow.

According to the present invention there is provided a manifold for a concentric tube heat exchanger, said manifold including first and second sealing elements which form seals in use with first and second tubes between which is defined a first flow path for a viscous fluid, said manifold including a first port which communicates, in use, with the first flow path, said manifold further including flow directing means for directing flow of viscous fluid in use toward said port.

Preferably, said flow directing means comprises a shoulder which is oblique relative to the axes of the tubes and which directs the viscous material towards the port.

The invention will now be further described with reference to the accompanying drawings, in which.

Figure 1:
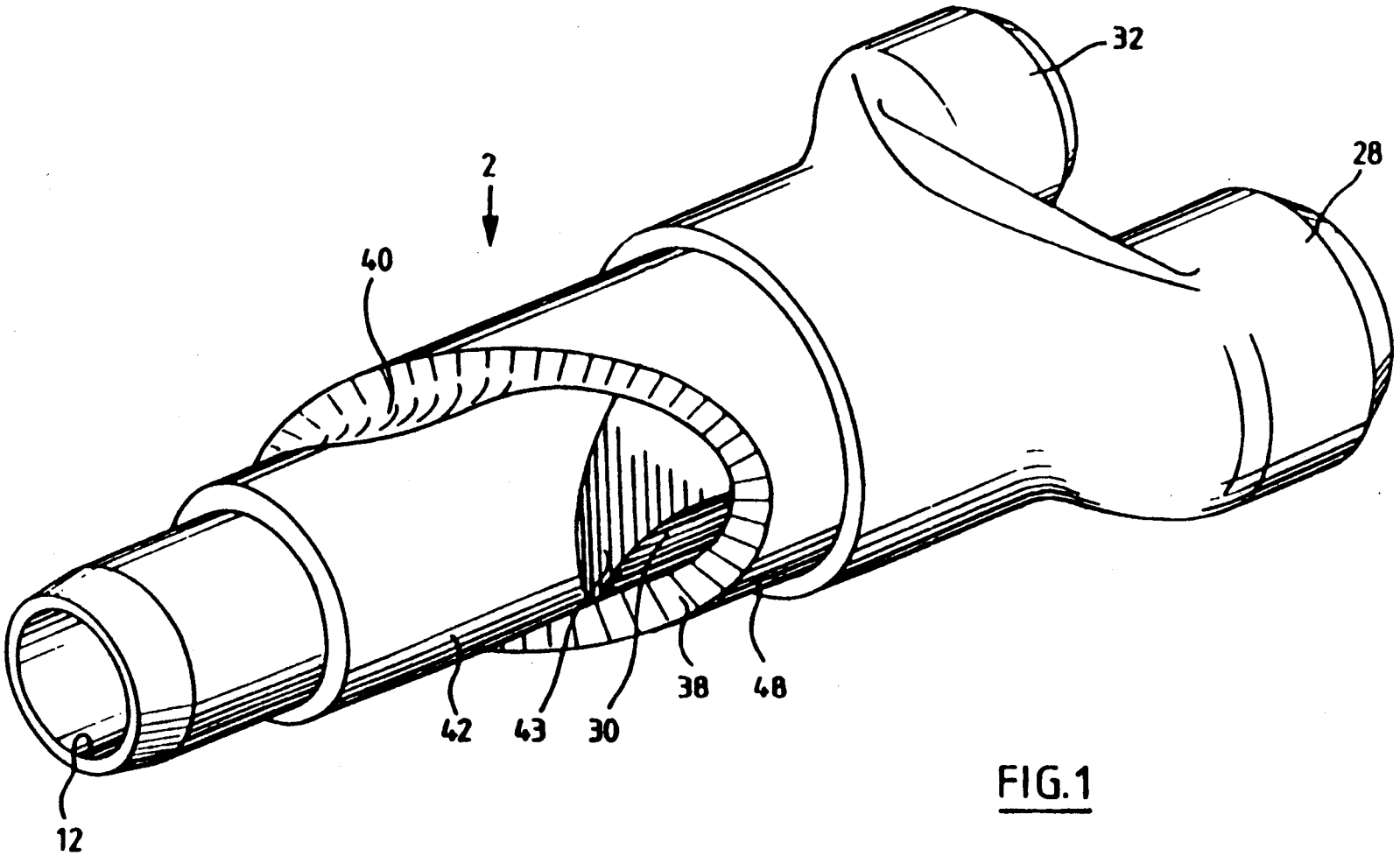
FIG. 1 is a simplified perspective view of an end manifold constructed in accordance with the invention.

The end manifold 2 illustrated in FIG. 1 is preferably cast from stainless steel. A pair of the manifolds 2 are used in conjunction with a plurality of concentrically disposed heat exchanger tubes 4, 6, 8 and 10 to form a heat exchanger for heating or cooling fluids. A long tension bolt (not shown) passes through a central bore 12 in the manifold 2, the tension bolt serving to clamp the heat transfer tubes between the two end manifolds. The overall arrangement is similar to that disclosed in U.S. Pat. No. 4,146,088.

Figure 3:
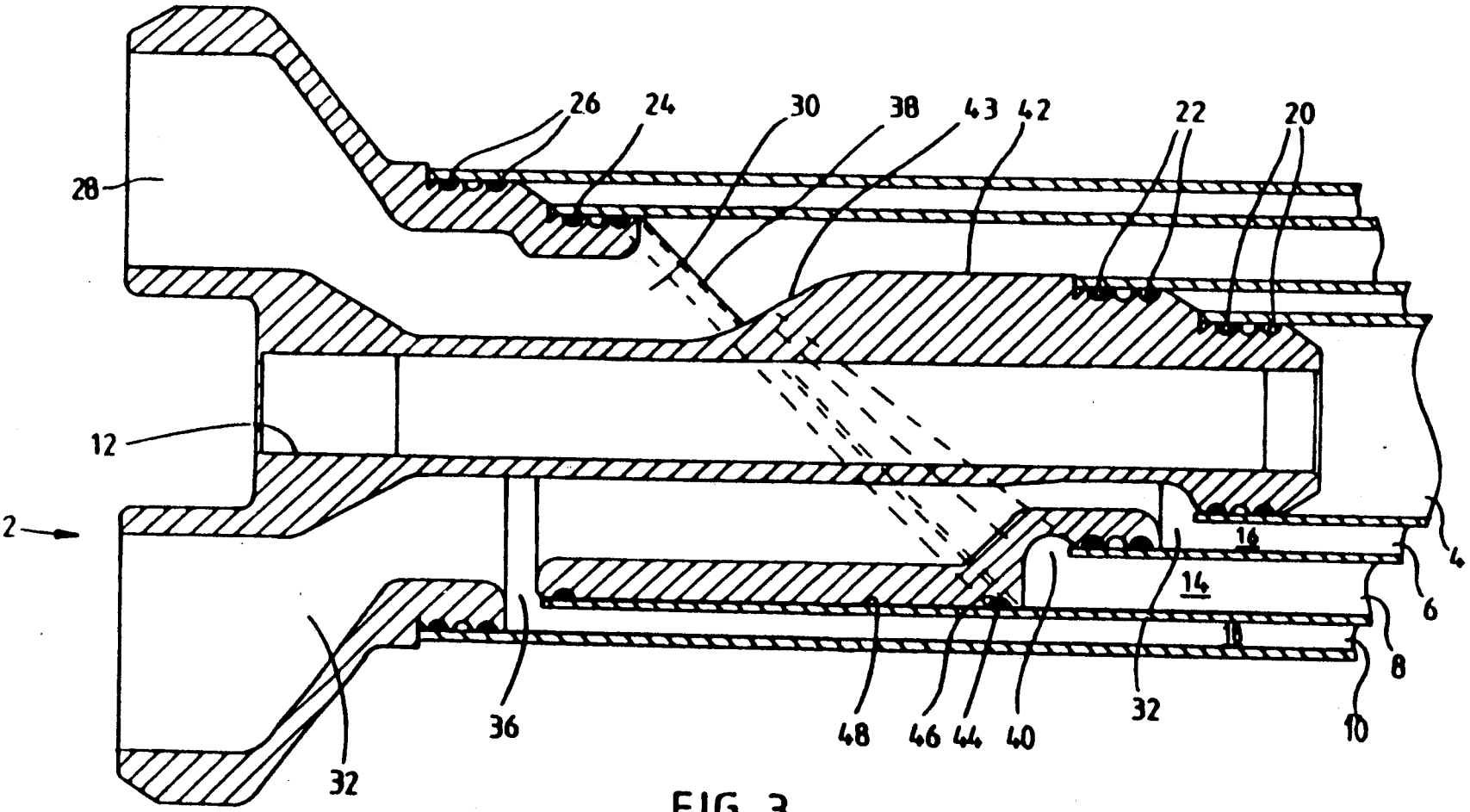
FIG. 3 is a longitudinal section through a heat exchanger incorporating the manifold of the invention.
Figure 4:
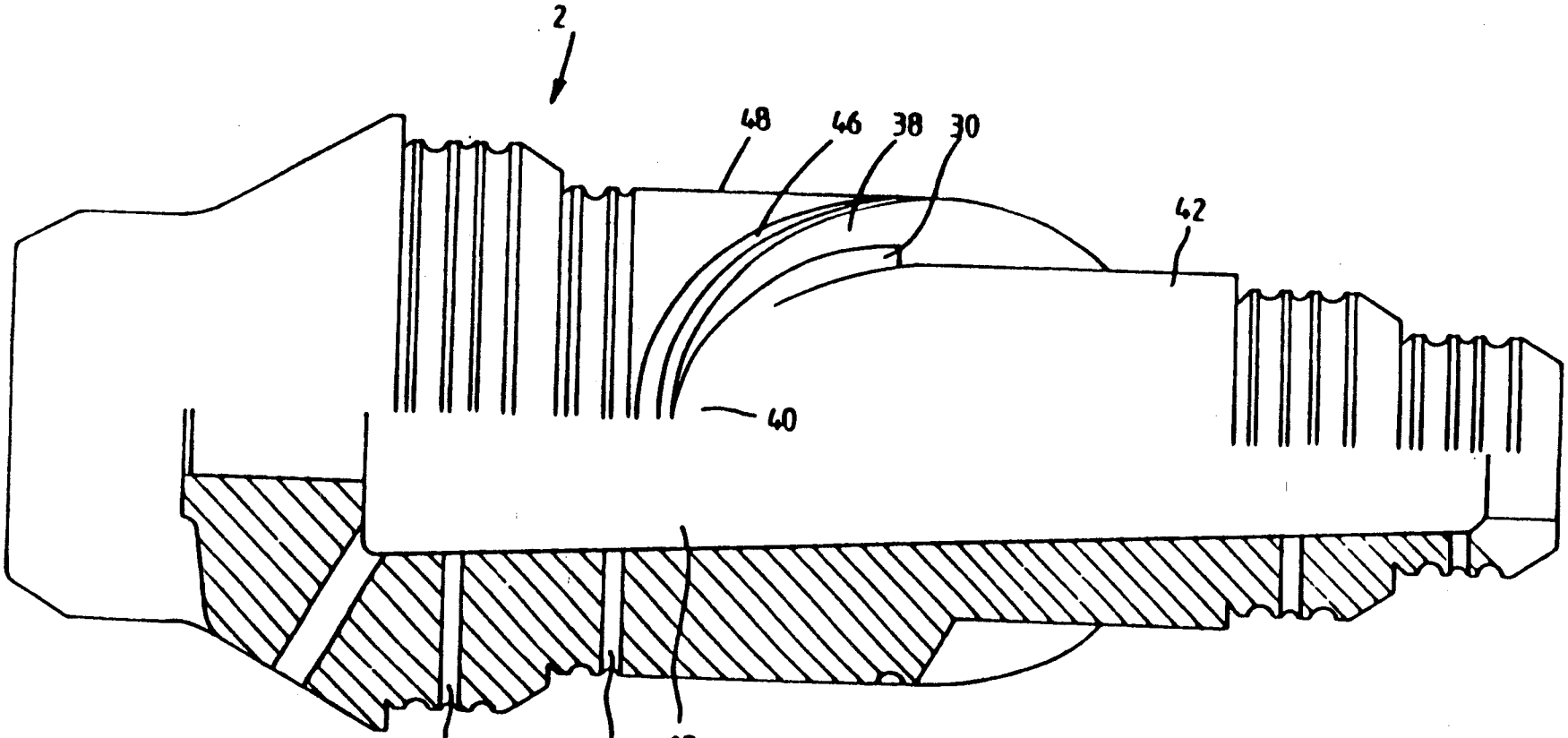
FIG. 4 is a plan view in part section.
Figure 5:
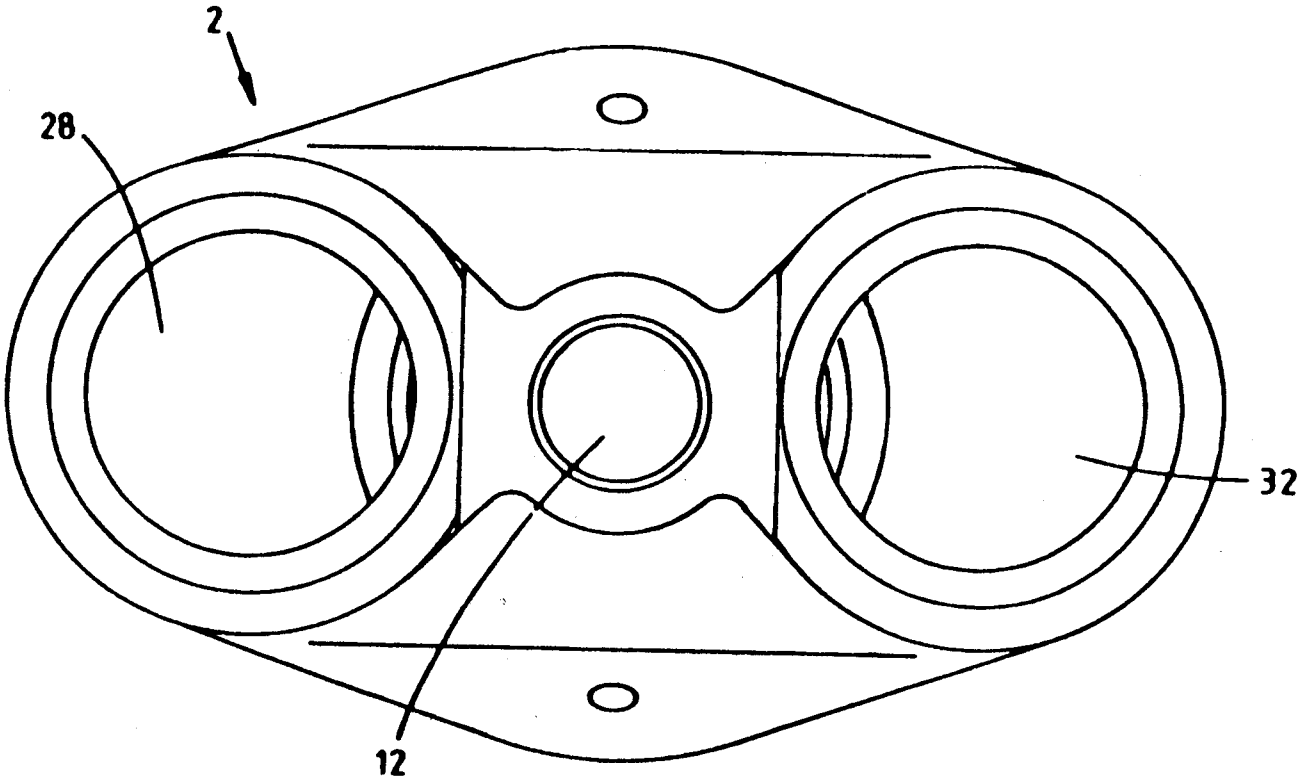
FIG. 5 is a view along the line 5—5.
Figure 8:
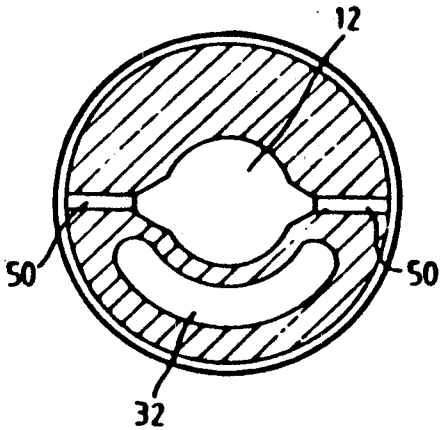
FIG. 8 is a cross-sectional view along the line 8—8.
Figure 7:
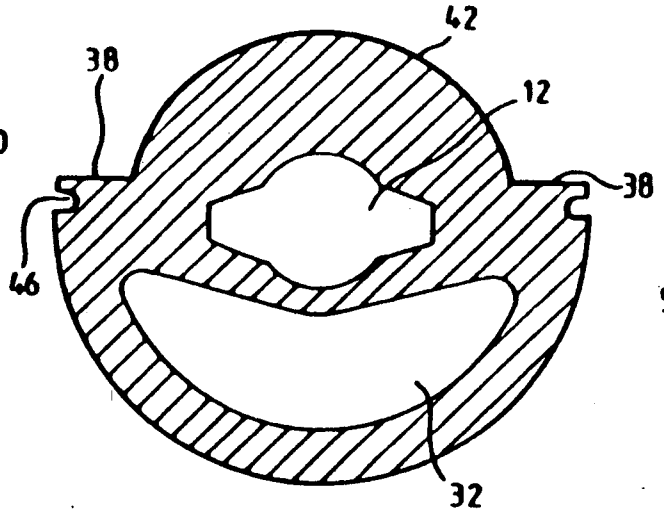
FIG. 7 is a cross-sectional view along the line 7—7.
Figure 6:
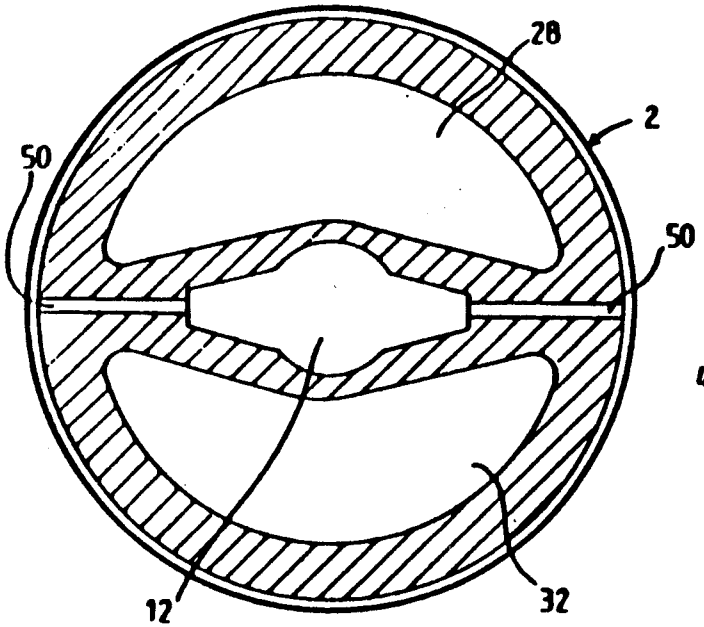
FIG. 6 is a cross-sectional view along the line 6—6.

As shown in FIG. 3, a viscous fluid flow path 14 is located in the annular space between the tubes 6 and 8. An inner jacket 16 is located in the annular space between the tubes 4 and 6 and an outer jacket 18 is located in the annular space between the tubes 8 and 10. Normally steam under pressure is circulated through the inner and outer jackets in order to heat the material in the flow path 14. Pairs of O-rings 20, 22, and 26 are provided to form a seal between the manifold 2 and the inner surfaces of the tubes 4, 6 and 10 respectively. An O-ring 24 is provided to form a seal between the end manifold 2 and the inner surface of the tube 8 and an elliptical O-ring 44 also seals against the inner surface of the tube 8, as will be described hereinafter. Except for the O-ring 44, the O-rings extend in circumferential grooves provided in the body of the manifold 2. The flow path 14 communicates with an inlet/outlet passage 28 via a port 30, as best seen in FIGS. 1 and 3. The inner and outer jackets 16 and 18 communicate with an inlet/-outlet passage 32 for steam via respective ports 34 and 36.

Figure 2:
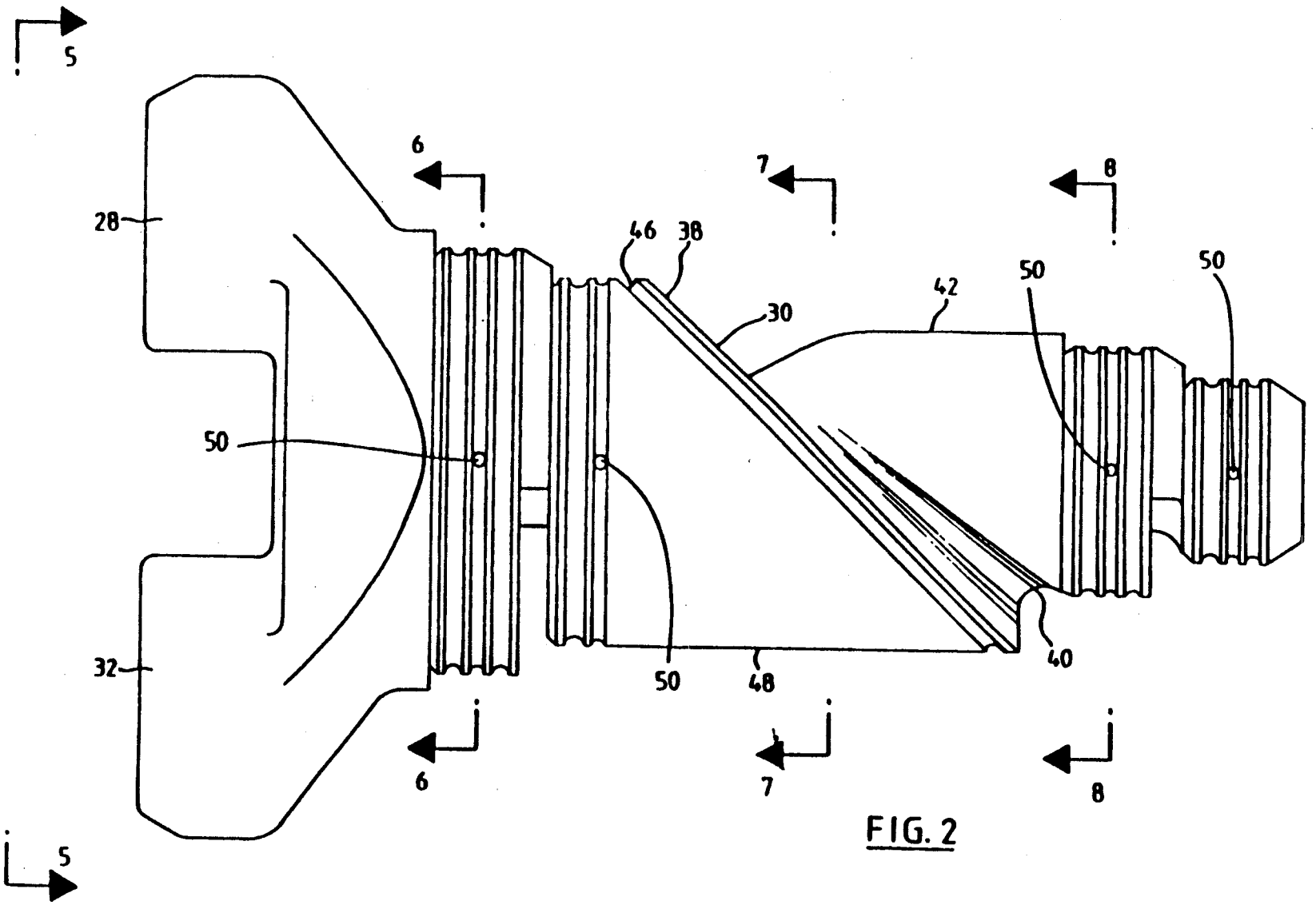
FIG. 2 is a side view of the end manifold.

In accordance with the invention, an obliquely oriented shoulder 38 is provided by the manifold 2 at the end of the flow path 14. As best seen in FIGS. 1 and 2, the shoulder 38 forms an angle of about 45° relative to the longitudinal axis of the tubes, the most suitable range of angles being 25° to 65°. When the manifold is used for exit of viscous fluid, the shoulder 38 directs the viscous fluid flowing in passage 14 to the port 30 and prevents stagnation of fluid in the path opposite to the port 30. As best seen in FIGS. 1 and 3 the cylindrical wall 42 includes an inclined wall portion 43 adjacent to the mouth of the port 30 to assist in directing fluid into or out of) the port 30. The wall portion 43 preferably forms an angle of about 30° to the axes of the tubes. It serves to direct fluid flowing in the passage 14 towards the port 30. In a normal heat exchanger of this type, the shoulder 38 would be transverse to the axis of the tubes and there would be a tendency for the viscous material to accumulate at a region of no flow which is diametrically opposite to the port 30. Because of the shape of the heat exchanger and in particular the shoulder 38, the no flow region is avoided. Thus when the heat exchanger is used for heating, accumulations of burnt viscous fluid are avoided. When used for cooling accumulations of over-cooled or frozen fluid are avoided. The same shape manifold can also be used at the inlet end of the exchanger and the obliquely oriented shoulder will tend to avoid accumulations of viscous fluid.

The illustrated arrangement includes a groove 40 which is formed into the cylindrical wall 42 of the manifold 2 inwardly adjacent to the shoulder 38. The groove 40 decreases in depth as it extends towards the port 30. The groove 40 tends to create a region of low pressure in the flowing fluid which further enhances the tendency of the viscous fluid to flow towards the port 30.

In the illustrated arrangement, the O-ring 44 is provided in a recess 46 which is machined into the cylindrical surface 48 inwardly adjacent to the shoulder 38. It will be appreciated that the O-ring 44 will assume a generally elliptical shape but it nevertheless forms a satisfactory seal with the inner surface of the tube 8. Furthermore, it is a relatively straightforward matter to machine the elliptical groove 46 into the cylindrical surface 48.

Many modifications will be apparent to those skilled in the art without departing from the spirit and scope of the invention. For instance, the manifold may include radially extending ducts 50 which can be used to detect leaks in the seals provided by the O-rings, in a similar manner to that disclosed in Australian Patent No. 510518. The ducts can also be used to provide flow paths to the space between seals for flushing a cleaning fluid through the space.

Figure 9:
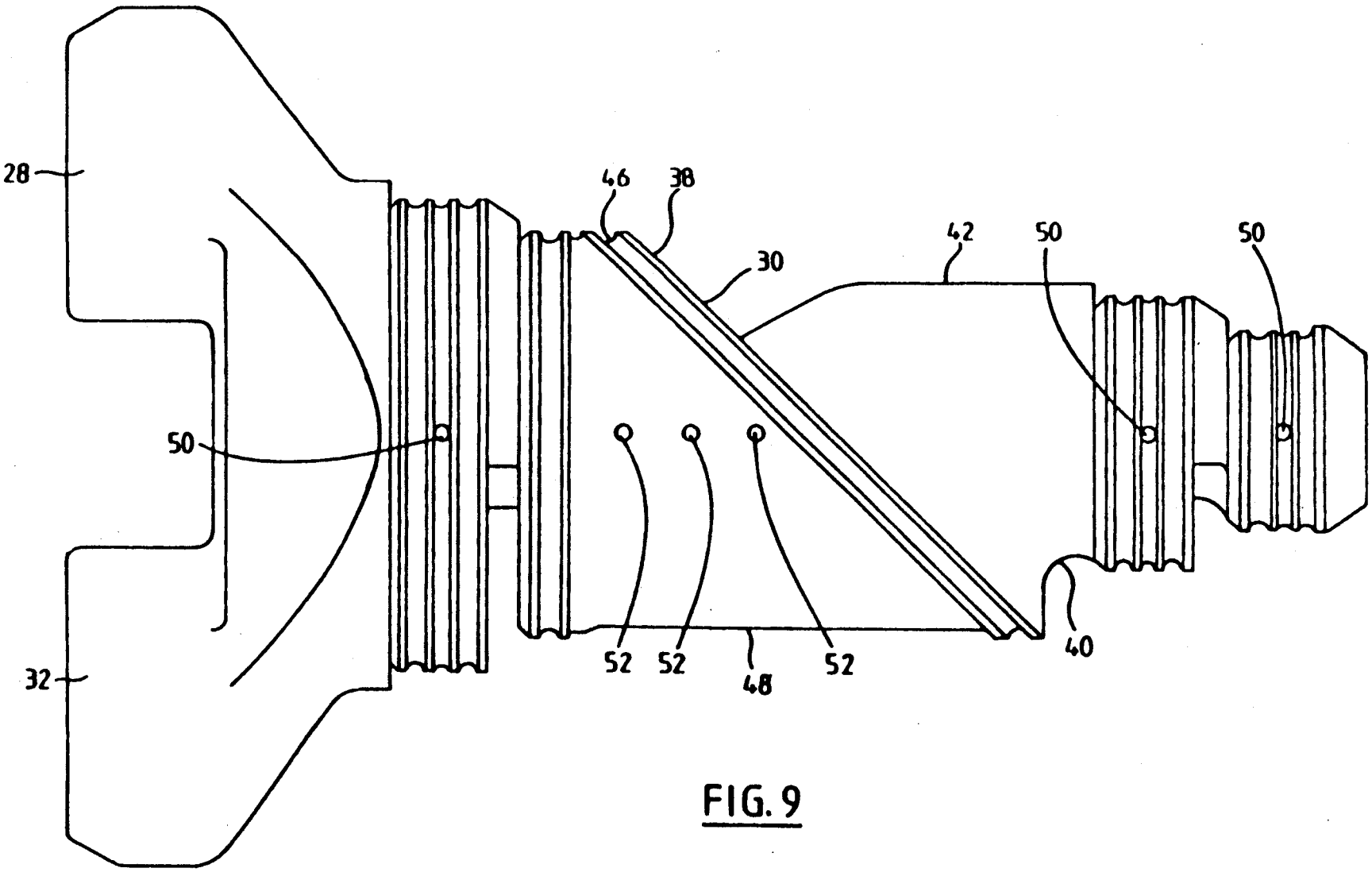
FIG. 9 is a side view of a modified manifold.

FIG. 9 illustrates a modified arrangement in which provision is made for flushing the cylindrical surface 48. This is achieved by reducing the radius of the surface 48 by up to 5 mm and preferably 2 to 3 mm relative to the inside radius of the heat transfer tube 8. This provides a good clearance between the surface 48 and the inner surface of the tube 8 so that a purging fluid can be circulated over the entire area. To assist flow of purging fluid a number of purging ducts 52 are provided in the surface 48, the ducts 52 extending into the central bore 12, as before. The purging fluid will clear away any accumulated materials which could cause contamination of the fluids being treated or corrosion of the manifold. The purging fluid can be circulated using techniques similar to those disclosed in U.S. Pat. No. 4,440,243.

It will be appreciated that the end manifolds disclosed herein can be used at one or both ends of a heat exchanger. It will be further appreciated that the heat exchanger incorporating the end manifolds of the invention can be used for heating liquids with steam or other heated medium and can be used for cooling as well. The avoidance of regions of now flow also significantly improves the effectiveness of cleaning of the exchanger by circulating a cleaning fluid through it.

Many further modifications will be apparent to those skilled in the art.

I claim:

1. An end manifold (2) for a concentric tube heat exchanger, said manifold including first sealing means (22) which, in use, form a seal with a first tube (6), second sealing means (24, 44) which, in use, form a seal with a second tube (8), the first sealing means being located closer to a forward end of the manifold and the second sealing means being located closer to a rearward end of the manifold, a first fluid flow path (14) being defined between the first and second tubes (6 and 8), said manifold including a first port (30) which, in use, communicates with said first fluid flow path (14) characterised in that the manifold includes a shoulder (38), the orientation of which is oblique with respect to the axes of said tubes.

2. An end manifold as claimed in claim 1 wherein said first port (30) is located adjacent to a rearward part of the shoulder (38).

3. An end manifold as claimed in claim 2 wherein the shoulder is defined by a surface which makes an angle in the range of 25° to 65° relative to the axes of the tubes.

4. An end manifold as claimed in claim 3 wherein said angle is 45°.

5. An end manifold as claimed in any one of claims 1 to 4 wherein the second sealing means includes a generally elliptical O-ring (44) which lies in a recess (46) adjacent to the shoulder (38).

6. An end manifold as claimed in any one of claims 1 to 4 wherein the manifold includes an inclined surface (43) adjacent to an inner part of said first port (30).

7. An end manifold as claimed in claim 1 including third and fourth sealing means (20 and 26) which, in use, form seals with third and fourth tubes (4 and 10) respectively to thereby define second and third fluid flow paths (16 and 18) inwardly and outwardly adjacent to the first flow path respectively, said manifold including second and third ports (34 and 36) for communicating, in use, with the second and third fluid flow paths.

8. An end manifold as claimed in claim 1 including a groove (40) which is forwardly disposed relative to the shoulder (38) and sweeps about the manifold generally adjacent to the shoulder (38).

9. An end manifold as claimed in claim 8 wherein the groove decreases in depth in directions towards the first port (30).

10. An end manifold as claimed in claim 5 wherein second sealing means includes a circular O-ring (24) located in a recess which extends about a cylindrical wall (48) of the manifold.

11. An end manifold as claimed in claim 10 wherein the cylindrical wall (48) between said elliptical O-ring (44) and said circular O-ring (24) is recessed to define a gap, in use, between the end manifold and the inner surface of the outermost of said first and second tubes (8 and 6).

12. An end manifold as claimed in claim 1 including a central bore (12) and a plurality of ducts (50, 52) which extend from said sealing means to said bore (12).

13. An end manifold as claimed in claim 1 wherein said manifold is disposed on at least one of the ends of said heat exchanger and includes a plurality of concentric tubes (4, 6, 8, 10) clamped therebetween to define a plurality of fluid flow paths (14, 16, 18) between adjacent tubes.

* * * * *